US006561674B2

(12) United States Patent
Gibboney, Jr.

(10) Patent No.: US 6,561,674 B2
(45) Date of Patent: May 13, 2003

(54) RIBBON LIGHT STRING

(75) Inventor: James W Gibboney, Jr., Conyers, GA (US)

(73) Assignee: Global Research & Development Corp., Suwanee, GA (US)

( * ) Notice: Subject to any disclaimer, the term of this patent is extended or adjusted under 35 U.S.C. 154(b) by 0 days.

(21) Appl. No.: 09/853,143

(22) Filed: May 10, 2001

(65) Prior Publication Data

US 2001/0043472 A1 Nov. 22, 2001

Related U.S. Application Data

(60) Provisional application No. 60/203,700, filed on May 11, 2000.

(51) Int. Cl.[7] ..... F21V 33/00
(52) U.S. Cl. ..... 362/253; 362/234; 362/249
(58) Field of Search ..... 362/234, 249, 362/253

(56) References Cited

U.S. PATENT DOCUMENTS 1,512,888 A * 10/1924 Haft ..... 362/249
3,714,414 A * 1/1973 Sternius ..... 362/249
3,894,225 A * 7/1975 Chao ..... 362/249
4,173,035 A * 10/1979 Hoyt ..... 362/249
4,482,944 A * 11/1984 Roossine et al. ..... 362/418
4,514,791 A * 4/1985 Tokieda ..... 362/249
4,667,276 A * 5/1987 Cheng ..... 362/249
4,720,773 A * 1/1988 Ahroni ..... 362/249
4,885,664 A * 12/1989 Hermanson ..... 362/123
5,410,459 A * 4/1995 Yang ..... 362/249
5,769,533 A * 6/1998 Yamuro et al. ..... 362/249
6,116,752 A * 9/2000 Mayfield et al. ..... 362/252
6,149,284 A * 11/2000 Wang ..... 362/249
6,352,355 B1 * 3/2002 Law ..... 362/253

* cited by examiner

*Primary Examiner*—Sandra O'Shea
*Assistant Examiner*—Ismael Negron
(74) *Attorney, Agent, or Firm*—Michael A Mann; Nexsen Pruet Jacobs & Pollard LLC

(57) ABSTRACT

Through the use of a variety of reinforcing structures, a ribbon light string is described that can be shaped in decorative ways, and it is made of a material that, due to its coloring and/or texture, can become camouflaged into its environment, or of a material that is preferably reflective and compliments the light from the lamp bulbs of the light string. Essentially, the ribbon light string is a reinforced ribbon having a passage therethrough for carrying substantially all, of the non-illuminating portion, of a light string while allowing the illuminating portion to be exposed. To facilitate the shaping of the ribbon, several embodiments are described including the use of pliable ribbon material; the use of at least one reinforcing wire running through the longitudinal extent of the passage; or the use of a "ribbon wire" type conductor for the light string. Also described are the use of novel hole and flap arrangements and lamp bulb/lamp base configurations.

33 Claims, 4 Drawing Sheets

RIBBON LIGHT STRING

1. PRIORITY CLAIM

This application claims the benefit of the earlier filing date of provisional application, Serial No.: 60/203,700, filed on May 11, 2000.

2. FIELD OF THE INVENTION

The present invention relates to decorative light strings, such as those used to decorate Christmas trees.

3. BACKGROUND OF THE INVENTION

Light strings are used at holiday times to decorate homes and trees. In some commercial establishments light strings are used year round for decoration. As light strings have been developed that use smaller light bulbs, are cheaper to manufacture, and use less energy, the number of light strings being sold and used has increased dramatically.

Typically, a light string includes a plurality of small lights connected electrically together in series or in parallel (or in a combination of series and parallel connections) with a plug on one end that is insertable into an electrical outlet. A light string may have as many as 200 individual lights on it.

A drawback to the use of light strings, particularly in decorating Christmas trees or other parts of a home where the viewer will be relatively close to the decorations, is the appearance of the pair of wires that runs from light to light. These wires are usually a dark color, and will tend to blend in if used with a Christmas tree. However, they nonetheless detract from the appearance of the tree. Moreover, when a light string is used to decorate a mantle the wires can be hidden to a limited extent behind other decorations. In most cases, however, the wires are generally detractive and not attractive.

Therefore, a need remains for a light string wherein the conducting wires are not visible or at least not obtrusive.

SUMMARY OF THE INVENTION

According to its major aspects and briefly recited, the present invention is the combination of a decorative ribbon and a light string. Except for the lamp bulbs themselves, the light string runs through the interior of a two-panel ribbon. The bulbs extend through holes in the ribbon so that they alone are visible from the exterior of the ribbon. Preferably the ribbon has reinforcing wire to stiffen it so that the ribbon light string may be shaped for good aesthetic effect.

The use of reinforced ribbon is an important feature of the present invention, the reinforcing allows a greater range of materials to be used for the ribbon itself, including those with limited structural stiffness, and facilitates the shaping of the ribbon into aesthetic forms that display both the ribbon and the lights carried by it.

The use of two-panel ribbon is another important feature of the present invention because, regardless of the ribbon's orientation, the panels allow the conducting wires of the light string to be completely hidden by the ribbon, while allowing the illuminating portion of the lamps to be visible.

Still another important feature of the invention is the use of shiny or reflective ribbon materials, which can enhance the light from the lamps by reflecting it from the ribbon's surface.

These and other features and their advantages will be apparent to those skilled in the art of decorative lighting from a careful reading of the Detailed Description of Preferred Embodiments accompanied by the following drawings.

BRIEF DESCRIPTION OF THE DRAWINGS

In the figures.

DETAILED DESCRIPTION OF PREFERRED EMBODIMENTS

The present invention is, in combination, a light string and a ribbon. The term "light string" refers to a plurality of lamps connected electrically by wires either in series, in parallel, or in a series/parallel combination, powered either by alternating or direct current, and having a male electrical plug at one end and a female electrical plug at the other end to facilitate the cascading of multiple strings. When the male electrical plug is plugged into an energized wall outlet, or into the female plug of either an energized extension cord or another energized light string, the lamps in the string light up.

The term "ribbon" is used in a geometric sense and generally refers to a thin, flat material having a major dimension that is considerably longer than its minor dimension and a minor dimension much greater than its thickness. The term "ribbon" is also generally characterized by a relatively high degree of flexibility, i.e., it can be formed into various shapes including bows, for example.

Figure 1:
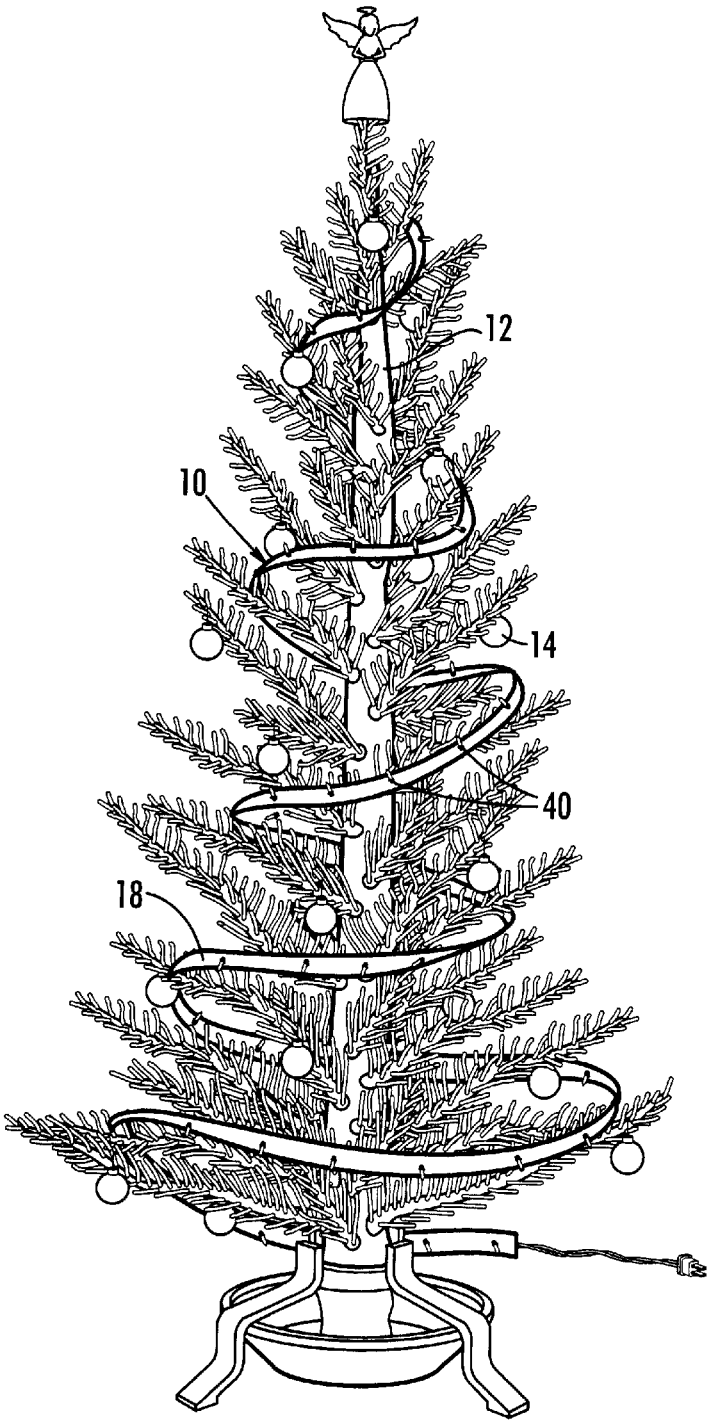
FIG. 1 is a Christmas tree with a ribbon light string, according to a preferred embodiment of the present invention.

Referring now to the figures, there is illustrated in FIG. 1 an example of the utility of the present invention of a ribbon light string 10, namely, to decorate a Christmas tree 12 having ornaments 14, according to a preferred embodiment of the present invention. Ribbon light string 10 includes a plurality of individual lamps 40 carried by a length of ribbon 18.

Figure 2:
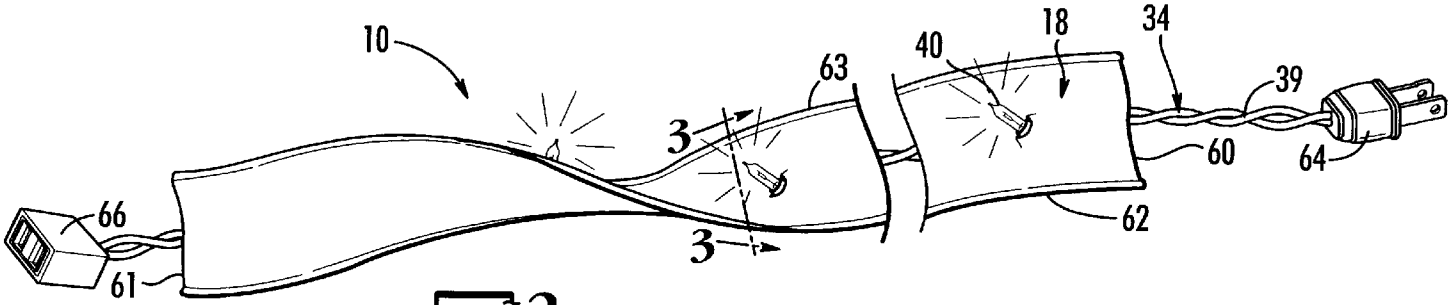
FIG. 2 is a detail of the ribbon light string, according to a preferred embodiment of the present invention.
Figure 4:
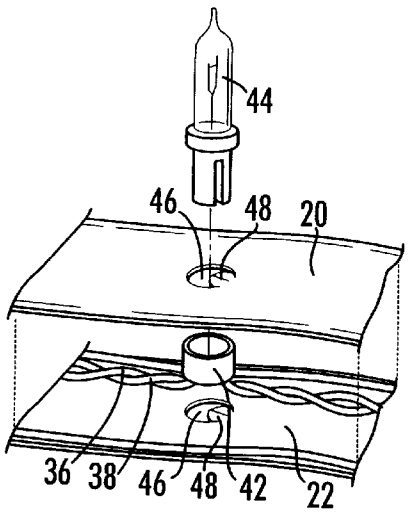
FIG. 4 is a detailed view of a preferred method for securing a lamp to the ribbon material by cutting C-shaped holes out of the upper and lower panels of the ribbon light string, according to a preferred embodiment of the present invention.
Figure 3:
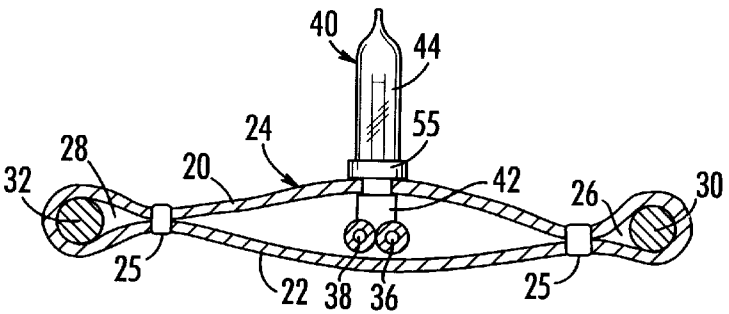
FIG. 3 is a cross sectional view of a ribbon light string of FIG. 2, taken along lines 3—3.

FIGS. 2, 3, and 4 illustrate detailed views of a ribbon light string 10 from the side and in cross sectional view, according to a preferred embodiment of the present invention. As shown, ribbon 18 includes two panels an upper panel 20 and a lower panel 22 that are joined together to form a pocket or sleeve 24. Panels 20, 22, need not be the same width, i.e., one of them can be narrower than the other, as long as the panels when joined together form sleeve 24 that is wide enough to accommodate the light string 34 inside sleeve 24. Sleeve 24 has two channels 26, 28, formed in its lateral extremities. It is preferred that these channels are dimensioned to receive reinforcing wires 30, 32, and are preferably formed by sewing, gluing, heat sealing, or by some other convenient method, a hem 25 near both longitudinal edges 62, 63 of ribbon 18. Reinforcing wires 30, 32, are preferably made of steel, plastic or other material that is malleable so that it can be formed into a shape that will remain until it is bent again. Thus, reinforcing wires 30, 32, should provide sufficient structure to hold ribbon 18 in a given shape.

Figure 9:
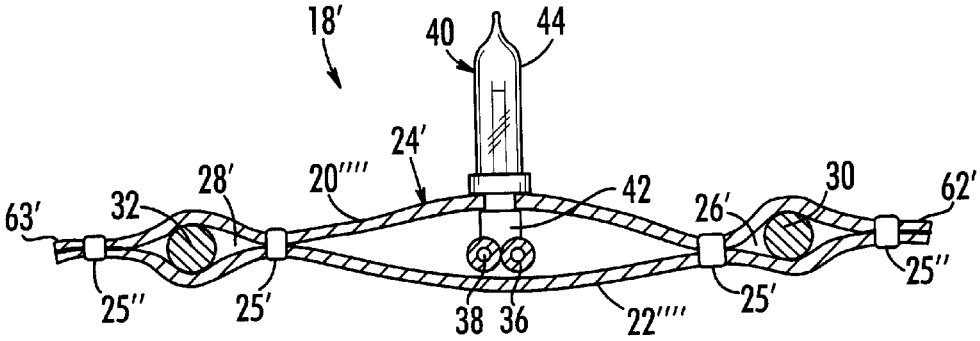
FIG. 9 is a cross sectional view of a ribbon light string showing the use of two hems on each side of the longitudinal centerline of the ribbon light string, according to a preferred embodiment of the present invention.

Reinforcing wires 30, 32, allow the user to crinkle or shape ribbon 18 into a decorative form, such as a spiral, a curl, a loop or a bow where it will remain in such shape until re-formed into a different shape. The channels 26, 28 can be located anywhere and do not necessarily need to be located in the lateral extremities, as long as a channel 26 or 28 (or 26' or 28') is on each side of the longitudinal centerline between the longitudinal centerline and a longitudinal edge 62, 63 (or 62', 63'), and as an example, see the orientation of the channels 26', 28' shown in FIG. 9. Furthermore, the two reinforcing wires 30, 32, are not needed in order to be able to shape ribbon 18 (or 18'). However, this arrangement and number of reinforcing wires is preferred. Alternatively, a single reinforcing wire may provide the structure for shaping ribbon 18 (or 18'), which reinforcing wire may be located anywhere between the longitudinal edges 62, 63 (or 62', 63') as long as it runs longitudinally between the opposite longitudinal ends 60, 61 of ribbon 18 (or the longitudinal ends of ribbon 18' (not shown)), or, alternatively, a material may be selected for ribbon 18 (or 18') that has sufficient structural strength and flexibility so it can be bent, without the need of reinforcing wires 30, 32, into a shape that will remain until it is bent again. In an alternative embodiment, as shown in FIG. 5, the present ribbon light string 10 can be made using ribbon 18 in combination with light string 34', which is made by using "ribbon wire" 39 instead of conductors 36, 38, and potentially with more aggressive lighting effects, and perhaps based on the use of "rice" lights, not shown in FIG. 5, which are smaller than the miniature lights commonly used on Christmas light strings.

Figure 5:
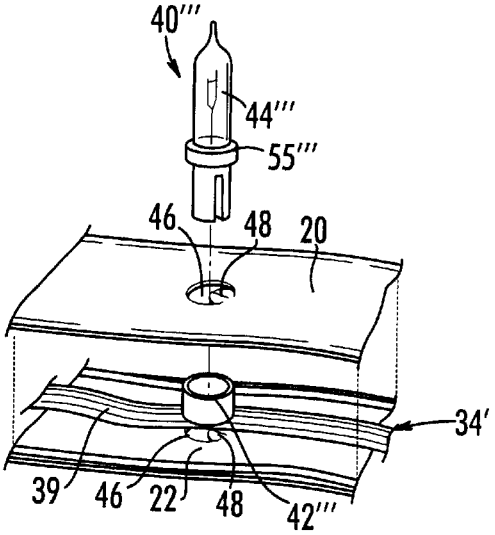
FIG. 5 is a detailed view of a preferred method for using ribbon wire, according to a preferred embodiment of the present invention.

Referring to FIGS. 1–5, a light string 34 (or 34') runs on the inside of sleeve 24 between panels 20 and 22, and extends beyond the sleeve's longitudinal ends 60, 61. Light string 34 includes two electrical conductors 36, 38, which are insulated electrical wires, and a plurality of lamps 40, which are connected to electrical conductors 36, 38, while light string 34' includes the connection of a plurality of lamps 40''' to the ribbon wire 39 as shown in FIG. 5.

Each lamp 40 (or 40''') includes a lamp base 42 (or 42'''), a lamp flange 55 (or 55'''), and a lamp bulb 44 (or 44''') that is inserted into a lamp base 42 (or 42'''). Each lamp bulb 44 (or 44''') is energized by an electrical current carried by conductors 36 and 38 (or by ribbon wire 39) through a lamp base 42 (or 42''') in a manner that is well known. Each lamp bulb 44 (or 44''') extends through a C-shaped hole 46, as shown in FIGS. 4 and 5, formed in panel 20 or panel 22, or both panels 20, 22, of sleeve 24, so that each lamp bulb 44 (or 44''') is visible from the exterior of sleeve 24 but electrical conductors 36, 38, or "ribbon wire" 39 as shown in FIG. 5, are hidden inside sleeve 24. Each lamp bulb 44 (or 44''') can protrude from either panel 20 or from panel 22, or can alternate between the two panels 20, 22. Referring to all of the figures. Ribbon 18 (or 18') is preferably made of a decorative material and most preferably made of a material that is shiny so that it reflects, either spectrally or diffusely, the light from lamp bulbs 44 (or 44', 44'', 44'''). Panels 20 (or 20', 20'', 20'''), and/or 22 (or 22', 22'', 22''') need not be made of the same material or, if made of the same material, can be of different colors, such as red and green for Christmas. The material for any of these panels can be nearly any natural or synthetic fabric, preferably a woven fabric that is plasticized or covered with a foil.

To facilitate the holding of a lamp to either panel of a ribbon, there are various shaped aperture arrangements (that will be discussed below) that may be formed on either or both ribbon panels and through which the lamp bulbs extend. And, because of various novel design features, allow the lamps to be effectively held in place to either panel of the ribbon (also, to be discussed below).

Figure 6A:
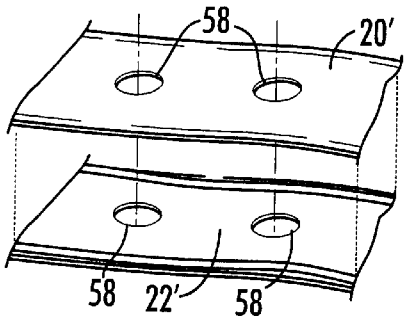
FIG. 6A is a detailed view of a preferred method of cutting circular holes out of the upper and lower panels of the ribbon light string, according to a preferred embodiment of the present invention.
Figure 6B:
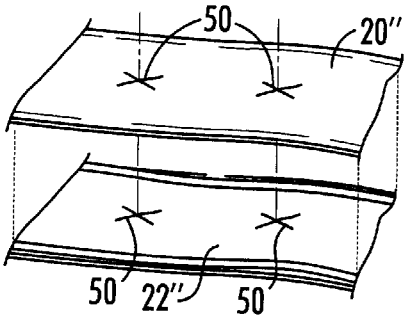
FIG. 6B is a detailed view of a preferred method of cutting X-shaped holes out of the upper and lower panels of the ribbon light string, according to a preferred embodiment of the present invention.
Figure 6C:
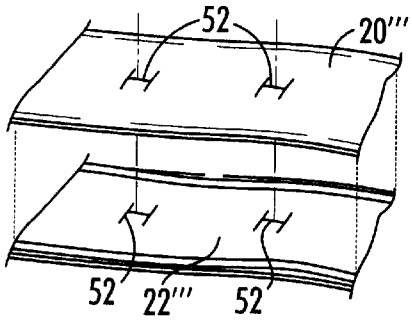
FIG. 6C is a detailed view of a preferred method of cutting H-shaped holes out of the upper and lower panels of the ribbon light string, according to a preferred embodiment of the present invention.
Figure 7:
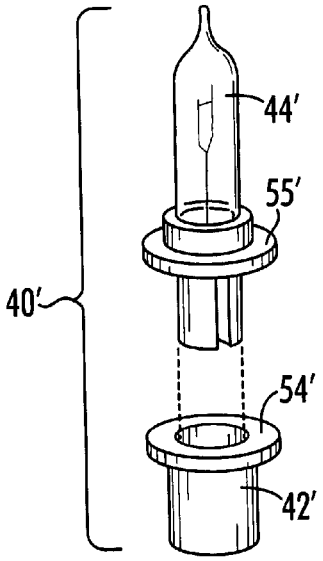
FIG. 7 is a detailed view of a preferred method of forming a flange on the lamp base and the lamp bulb for securing a lamp to the ribbon material, according to a preferred embodiment of the present invention.
Figure 8:
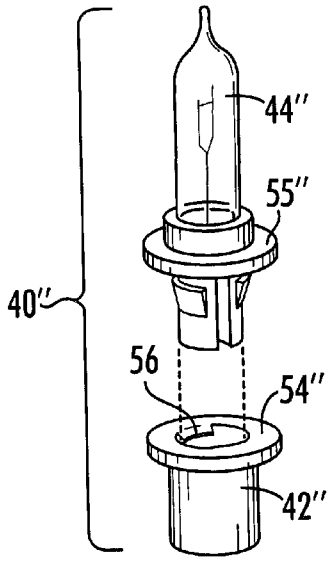
FIG. 8 is a detailed view of a preferred method of forming a clip mechanism on the lamp base and lamp bulb together for securing a lamp to the ribbon material, according to a preferred embodiment of the present invention.

More specifically, instead of using circular holes 58 (as shown in FIG. 6A), it is preferable to form C-shaped holes 46 in order to better hold each lamp 40 in place, as shown in FIG. 4 (or lamp 40''', as shown in FIG. 5). (Of course, any of the lamps 40, 40', 40'', or 40''' can be used with either the circular holes 58 or the C-shaped holes 46.) The uncut portion of the C-shaped hole 46 defines a flap 48 that can be inserted into lamp base 42, 42', 42'', or 42''', or between the lamp base 42, 42', 42'', or 42''' and the lamp bulb flange 55, 55', 55'', or 55'''. For example, when lamp bulb 44 is inserted into lamp base 42, it holds flap 48 and thus panel 22, or panel 20, as shown in FIG. 4, to lamp 40. Alternatively, a hole and flap arrangement in the shape of an "X" 50 as shown in FIG. 6B, or a hole and flap arrangement in the shape of an "H" 52 as shown in FIG. 6C, or other similar hole and flap arrangement in some other shape may be formed (and used with any of the lamps 40, 40', 40'', or 40'''). Similarly, in another preferred embodiment a flange 54' can be formed on lamp base 42' and a flange 55' can be formed on lamp bulb 44' as shown in FIG. 7, or a clip 56 and flange 54'', 55'' arrangement can be formed as shown in FIG. 8, and either can be used to pinch the perimeter of a circular hole 58, or pinch the flap 48 of the C-shaped hole 46, or pinch the hole and flap arrangement in the shape of an "X" 50, or the hole and flap arrangement in the shape of an "H" 52, to the lamp 40' (or 40'').

In other words, the hole and flap arrangements of the C-shaped hole 46, the circular hole 58, the hole and flap arrangement in the shape of an "X" 50 as shown in FIG. 6B, or the hole and flap arrangement in the shape of an "H" 52, can be used with any of the lamps 40, 40', 40'', or 40''' or light strings 34 or 34', as appropriate.

Preferably the longitudinal ends 60, 61 of ribbon 18 (or of ribbon 18', the ends of which are not shown) are finished so that conductors 36, 38, (or the ribbon wire 39) in the immediate vicinity of a male plug 64 and a female plug 66 are held within sleeve 24 (or 24') between panels 20 and 22 (or 20', 20–, 20''' and 22', 22'', 22''' respectively) allowing the plugs 64, 66 to extend a short distance from the longitudinal ends 60, 61 of ribbon 18 (or of ribbon 18' (not shown)). Other modifications and substitutions can be made to these preferred embodiments without departing from the spirit and scope of the present invention, defined by the appended claims.

What is claimed is:

1. A ribbon light string, comprising:

a ribbon, said ribbon having an upper and a lower panel, said panels having a plurality of holes cut out of at least one of said panels, said panels are joined together along the longitudinal edges of said panels, whereby a sleeve is formed between said edges that longitudinally extends for a portion of the longitudinal length of said ribbon;

a light string carried by said sleeve having at least two insulated electrical conductors, said light string having a male and a female electrical plug, said male and female plugs extending beyond opposite longitudinal ends of said ribbon, and said light string having a plurality of lamps connected to said conductors, said lamps having lamp bulbs that extend outside of said sleeve through said holes, said lamps having lamp bases attached to said conductors; and at least one reinforcing wire within said sleeve, said reinforcing wire longitudinally extending for a portion of said longitudinal length of said sleeve.

2. The ribbon light string of claim 1, further comprising two channels, each of said channels being formed on opposite sides of the longitudinal centerline of said sleeve by joining said upper panel and said lower panel together for a portion of said longitudinal length of said sleeve, wherein at least one of said channels has contained within said channel at least one of said reinforcing wires longitudinally extending for a portion of said longitudinal length of said sleeve.

3. The ribbon light string of claim 1, wherein said holes are C-shaped, said C-shaped holes being dimensioned to frictionally hold said lamp bulb in said C-shaped hole, wherein, after inserting said lamp bulb through said C-shaped hole and into said lamp base, said lamp is held to said panel.

4. The ribbon light string of claim 1, wherein said holes are X-shaped, said X-shaped holes being dimensioned to frictionally hold said lamp bulb in said X-shaped hole.

5. The ribbon light string of claim 1, wherein said holes are H-shaped, said H-shaped holes being dimensioned to frictionally hold said lamp bulb in said H-shaped hole.

6. The ribbon light string of claim 1, wherein said ribbon is made of decorative material.

7. The ribbon light string of claim 1, wherein said ribbon is made of shiny material.

8. The ribbon light string of claim 1, wherein said upper panel and said lower panel are made of different materials.

9. The ribbon light string of claim 1, wherein said upper panel and said lower panel are made of different colors.

10. The ribbon light string of claim 1, wherein said opposite longitudinal ends are finished.

11. The ribbon light string of claim 1, wherein said ribbon is made of a moldable material.

12. The ribbon light string of claim 11, wherein said moldable material is a plasticized natural material.

13. The ribbon light string of claim 11, wherein said moldable material is a plasticized synthetic material.

14. The ribbon light string of claim 11, wherein said moldable material is a foil covered natural material.

15. The ribbon light string of claim 11, wherein said moldable material is a foil covered synthetic material.

16. A method for making a ribbon light string, comprising the steps of:

measuring the distance between lamp bases on a light string;

cutting holes the same distance apart as the distance between lamp bases in at least one of an upper panel and a lower panel;

inserting said lamp string between said upper panel and said lower panel, said light string having at least two insulated electrical conductors, said light string having a male and a female electrical plug, and said male and female plugs extending beyond opposite longitudinal ends of said panels;

forming a ribbon by joining said upper and lower panels together along the longitudinal edges of said panels, whereby a sleeve is formed between said longitudinal edges that longitudinally extends for a portion of the longitudinal length of said ribbon;

inserting at least one lamp bulb from outside said sleeve through one of said holes into a lamp base until proper electrical contact is made between said lamp bulb and said lamp base, and the illuminating portion of said lamp bulb extends outside of said sleeve; and finishing said opposite longitudinal ends of said panels.

17. The method for making a ribbon light string of claim 16, wherein said holes are C-shaped having a flap formed by the uncut portion of said C-shaped hole, said C-shaped hole and said flap being dimensioned so that the flap is inserted into said lamp base during insertion of said lamp bulb into said lamp base.

18. The method for making a ribbon light string of claim 16, wherein said holes are cut to form at least one flap, said hole and each flap being dimensioned so that at least one of said flaps is inserted into said lamp base during insertion of said lamp bulb into said lamp base.

19. The method for making a ribbon light string of claim 16, further comprising the steps of:

forming two longitudinally extending channels having one of said channels on each side of the longitudinal centerline of said sleeve by joining said upper panel and said lower panel together along at least one longitudinally extending hem on each side of said longitudinal centerline of said sleeve for a portion of said longitudinal length of said sleeve; and inserting at least one reinforcing wire within said sleeve, said reinforcing wire longitudinally extending for a portion of said longitudinal length of said sleeve.

20. The method for making a ribbon light string of claim 19, wherein at least one of said at least one reinforcing wire is contained within at least one of said two longitudinally extending channels for a portion of said longitudinal length of said sleeve.

21. The method for making a ribbon light string of claim 16, wherein said holes are circular and dimensioned so that the perimeter of the holes are pinched between said lamp bulb and said lamp base after insertion of said lamp bulb into said lamp base.

22. The method for making a ribbon light string of claim 21, further comprising the steps of:

forming a flange on each said lamp base; and forming a flange on each said lamp bulb, whereby said lamp bulb flange and said lamp base flange pinches the perimeter of the holes after insertion of said lamp bulb into said lamp base.

23. The method for making a ribbon light string of claim 21, further comprising the step of:

forming a clip on said lamp bulb and said lamp base together, wherein each said clip pinches the perimeter of said holes.

24. The method for making a ribbon light string of claim 23, wherein said channels are formed by two of said hems on each side of said longitudinal centerline between said longitudinal centerline and said longitudinal edge.

25. A ribbon light string, comprising:

a ribbon, said ribbon having an upper and a lower panel, said panels having a plurality of holes cut out of at least one of said panels, said panels are joined together along the longitudinal edges of said panels, whereby a sleeve is formed between said edges that longitudinally extends for a portion of the longitudinal length of said ribbon;

a light string carried by said sleeve having at least two electrical conductors, said light string having a male and a female electrical plug, said male and female plugs extending beyond opposite longitudinal ends of said ribbon, and said light string having a plurality of lamps connected to said conductors, each of said plurality of lamps having a lamp base and a lamp bulb, wherein each said lamp bulb extends outside of said sleeve through one of said holes after being inserted into one of said lamp bases;

means for holding each of said plurality of lamps to said sleeve; and means for reinforcing said sleeve so that said sleeve can be formed into a variety of shapes and wherein said sleeve will remain in such formed shape until formed into a different shape.

26. The ribbon light string of claim 25, wherein said means for reinforcing said sleeve is ribbon wire.

27. The ribbon light string of claim 25, wherein said means for reinforcing said sleeve is a pliable material used for fabricating said upper panel, said material allowing said sleeve to be bent into a shape in which said sleeve will remain until said sleeve is bent into a different shape.

28. The ribbon light string of claim 25, wherein said means for reinforcing said sleeve is a pliable material used for fabricating said lower panel, said material allowing said sleeve to be bent into a shape in which said sleeve will remain until said sleeve is bent into a different shape.

29. The ribbon light string of claim 25, wherein said means for reinforcing said sleeve is a pliable material used for fabricating both said lower panel and said upper panel, said material allowing said sleeve to be bent into a shape in which said sleeve will remain until said sleeve is bent into a different shape.

30. The ribbon light string of claim 25, wherein said means for holding each of said plurality of lamps to said sleeve is comprised of a flange formed on said lamp base and a flange formed on said lamp bulb, wherein inserting said lamp bulb into said lamp base causes said clip to hold a portion of said sleeve to said lamp.

31. The ribbon light string of claim 25, wherein said means for holding said plurality of lamps to said sleeve is comprised of a clip formed on said lamp base and said lamp bulb of each of said plurality of lamps, wherein inserting said lamp bulb into said lamp base causes said clip to hold a portion of said sleeve to said lamp.

32. The ribbon light string of claim 25, wherein at least one of said upper panel and said lower panel is made of a colored material, said colored material allowing said sleeve to become camouflaged.

33. The ribbon light string of claim 32, wherein said colored material is non-reflective.

* * * * *